US010030936B2

(12) United States Patent
Brasseur

(10) Patent No.: US 10,030,936 B2
(45) Date of Patent: Jul. 24, 2018

(54) ACTIVE RANGE CONTROLLED SIGHT

(71) Applicant: John Brasseur, Barrington, NH (US)

(72) Inventor: John Brasseur, Barrington, NH (US)

(73) Assignee: John Brasseur, Barrington, NH (US)

( * ) Notice: Subject to any disclaimer, the term of this patent is extended or adjusted under 35 U.S.C. 154(b) by 200 days.

(21) Appl. No.: 15/204,629

(22) Filed: Jul. 7, 2016

(65) Prior Publication Data

US 2017/0016698 A1 Jan. 19, 2017

Related U.S. Application Data

(60) Provisional application No. 62/192,912, filed on Jul. 15, 2015.

(51) Int. Cl.

| | |
|---|---|
| ***F41G 1/32*** | (2006.01) |
| ***F41G 1/467*** | (2006.01) |
| ***F41G 1/34*** | (2006.01) |
| ***F41G 1/473*** | (2006.01) |

(52) U.S. Cl.

CPC ..... *F41G 1/345* (2013.01); *F41G 1/467* (2013.01); *F41G 1/473* (2013.01)

(58) Field of Classification Search

CPC ..... F41G 1/345; F41G 1/467

USPC ..... 33/265; 124/87; 42/132, 142

See application file for complete search history.

(56) References Cited

U.S. PATENT DOCUMENTS

| | | | | | |
|---|---|---|---|---|---|
| 3,487,548 | A * | 1/1970 | Frydenlund | F41G 1/467 | 33/265 |
| 3,674,002 | A * | 7/1972 | Diamond, Sr. | F41G 1/467 | 124/24.1 |
| 4,170,071 | A * | 10/1979 | Mann | F41G 1/467 | 124/87 |
| 4,325,190 | A | 4/1982 | Duerst | | |
| 4,400,887 | A | 8/1983 | Mason | | |
| 4,481,717 | A * | 11/1984 | Kowalski | F41G 1/467 | 124/87 |
| 4,617,741 | A | 10/1986 | Bordeaux et al. | | |
| 5,122,932 | A | 6/1992 | Ziller | | |
| 5,419,050 | A | 5/1995 | Moore | | |
| 5,435,068 | A | 7/1995 | Thames et al. | | |
| 5,575,072 | A | 11/1996 | Eldridge | | |
| 5,634,278 | A | 6/1997 | London | | |
| 5,746,016 | A | 5/1998 | Freisinger et al. | | |
| 5,822,905 | A * | 10/1998 | Teetzel | F41C 23/16 | 362/114 |
| 5,914,775 | A | 6/1999 | Hargrove et al. | | |
| 6,042,245 | A * | 3/2000 | Stanley | F21V 21/32 | 124/87 |
| 6,073,352 | A * | 6/2000 | Zykan | F41G 1/467 | 33/265 |
| 6,154,971 | A | 12/2000 | Perkins | | |
| 6,199,286 | B1 * | 3/2001 | Reed, Jr. | F41G 1/467 | 124/87 |
| 6,397,483 | B1 | 6/2002 | Perkins | | |
| 6,494,604 | B2 | 12/2002 | Khoshnood | | |
| 6,725,854 | B1 | 4/2004 | Afshari | | |

(Continued)

*Primary Examiner* — Christopher Fulton

(74) *Attorney, Agent, or Firm* — Finch & Maloney PLLC

(57) ABSTRACT

A sight for a weapon such as a bow, crossbow or firearm is described. The sight includes different vertical indicators that are activated by separate switches on the weapon. The shooter intuitively knows which switch is associated with a greater distance, and the corresponding switch illuminates a range site to adjust for that distance.

20 Claims, 6 Drawing Sheets

(56) References Cited

U.S. PATENT DOCUMENTS

| | | | | |
|---|---|---|---|---|
| 6,796,037 | B1 | 9/2004 | Geffers et al. | |
| 6,952,881 | B2 | 10/2005 | McGivern | |
| 7,162,806 | B1 * | 1/2007 | Swiggart | F41G 1/467 124/87 |
| 7,895,996 | B2 | 3/2011 | Grove | |
| 7,905,046 | B2 * | 3/2011 | Smith, III | F41G 1/38 235/404 |
| 7,914,523 | B2 | 3/2011 | Barolet et al. | |
| 8,272,137 | B2 | 9/2012 | Logsdon | |
| 8,826,551 | B2 | 9/2014 | Gibson | |
| 9,249,947 | B2 | 2/2016 | Goldstein et al. | |
| 2003/0101604 | A1 | 6/2003 | McGivern | |
| 2004/0134114 | A1 | 7/2004 | Afshari | |
| 2008/0302348 | A1 | 12/2008 | Grove | |
| 2009/0211561 | A1 | 8/2009 | McFatridge | |
| 2009/0293855 | A1 * | 12/2009 | Danielson | F41G 1/35 124/87 |
| 2010/0298834 | A1 | 11/2010 | Hildebrandt | |
| 2011/0222046 | A1 * | 9/2011 | Overstreet | F41G 1/467 356/4.01 |
| 2012/0180770 | A1 | 7/2012 | McFatridge | |
| 2014/0152981 | A1 | 6/2014 | Lim et al. | |
| 2016/0184698 | A1 | 6/2016 | Tan | |

* cited by examiner

ACTIVE RANGE CONTROLLED SIGHT

RELATED APPLICATIONS

This application claims the benefit of U.S. Provisional Patent Application Ser. No. 62/192,912 filed on Jul. 15, 2015 and titled ACTIVE RANGE CONTROLLED SIGHT, which is incorporated by reference herein.

BACKGROUND

Field of Invention

The invention relates to sights for bows, crossbows and firearms and, in particular, to manually activated range indicator sights.

Discussion of Related Art

A variety of sights and sighting devices have been used with weapons such as bows, crossbows, rifles, pistols and air rifles. Sights may be mechanical, optical, electronic, or a combination thereof. Many sights include a visual indicator attached to the weapon that the user aligns with the target in order to aim the weapon at the target. The visual indicators may be positioned at different vertical positions, and each of the indicators may correspond to a different target distance, accounting for the drop of the projectile over a specific range. Some sights can include lights to increase their visibility in poor light conditions.

SUMMARY

In one aspect a sight for an archery bow or crossbow is provided, the sight comprising at least two illuminable range pins affixed to the bow, at least two switches affixed to the bow, each switch electrically connected exclusively to one of the illuminable range pins, and a power source constructed and arranged to illuminate a range pin when the corresponding switch is activated. In some embodiments, each switch can be a momentary switch that is biased to an off position and illuminates the corresponding range pin only when a force is applied by the user or each switch can be an on/off switch that illuminates the corresponding range pin when activated. The range pin may be turned off when the corresponding switch is activated a second time. A microprocessor is optional and need not be included in all embodiments. The range pins may be arranged vertically, and the at least two switches may be arranged vertically. In some cases, the lowest positioned of the at least two range pins is activated by the highest positioned of the at least two switches. The light from the illuminable range pins may be directly produced by the range pin, or the light may be reflected from another source. In some embodiments, more than one illuminable range pin can be illuminated concurrently.

In another aspect, a method of illuminating a range indicator is provided, the method comprising determining an approximate distance to a target, activating one of at least two switches vertically aligned on the grip of a weapon, each of the at least two switches configured to uniquely activate a different range sight that corresponds to a different target distance, illuminating a range sight associated with the activated switch, visually aligning the range sight with a target, and shooting a projectile at the target. In various embodiments, the weapon is a bow, crossbow or firearm. Each of the at least two switches may be positioned on the grip to be activated by a finger of a user without changing the position of the user's hand on the grip. The highest vertically aligned switch may be configured to activate the lowest positioned range sight. The range sight can be a range indicator and may be a reticle. The range sight can include a light emitting portion. The method may also include adjusting the lateral positioning of the range sight to compensate for wind drift. In some cases, the range sight is illuminated for as long and only for as long as the corresponding switch is activated by the shooter.

In another aspect, a sight for a firearm is provided, the sight comprising at least two switches affixed to the firearm, each of the at least two switches positioned to be activated by a different one of the shooter's fingers without altering the shooter's grip on the firearm, and one or more lights configured to be illuminated independently at different vertical positions within the sight, each vertical position uniquely illuminated by activating one of the at least three switches. In various embodiments, the sight is selected from an open sight, a peep sight, a telescopic sight and a dot sight. In some embodiments, the light is activated only when the switch is held in a closed position. In some embodiments, a first switch is positioned to be activated by the index finger, a second switch by the middle finger and a third switch by the ring finger, without moving the position of the hand on the firearm. The sight may include at least two independent circuits between the switches and the range pins or lights. In some cases, the positioning of the at least two switches can be swapped by a user, and they may be swapped between positions on a grip without electrically disconnecting the switches.

In another aspect, a sight system for a weapon is provided, the sight system comprising a sight including a plurality of illuminable range indicators, a grip cover positioned over a grip of the weapon, the grip cover defining a plurality of openings there through, and a plurality of button switches constructed and arranged to be removably retained in the openings, wherein each of the button switches is exclusively wired to one of the plurality of range indicators.

The subject matter of this application may involve, in some cases, interrelated products, alternative solutions to a particular problem, and/or a plurality of different uses of a single system or article.

DETAILED DESCRIPTION

Figure 1:
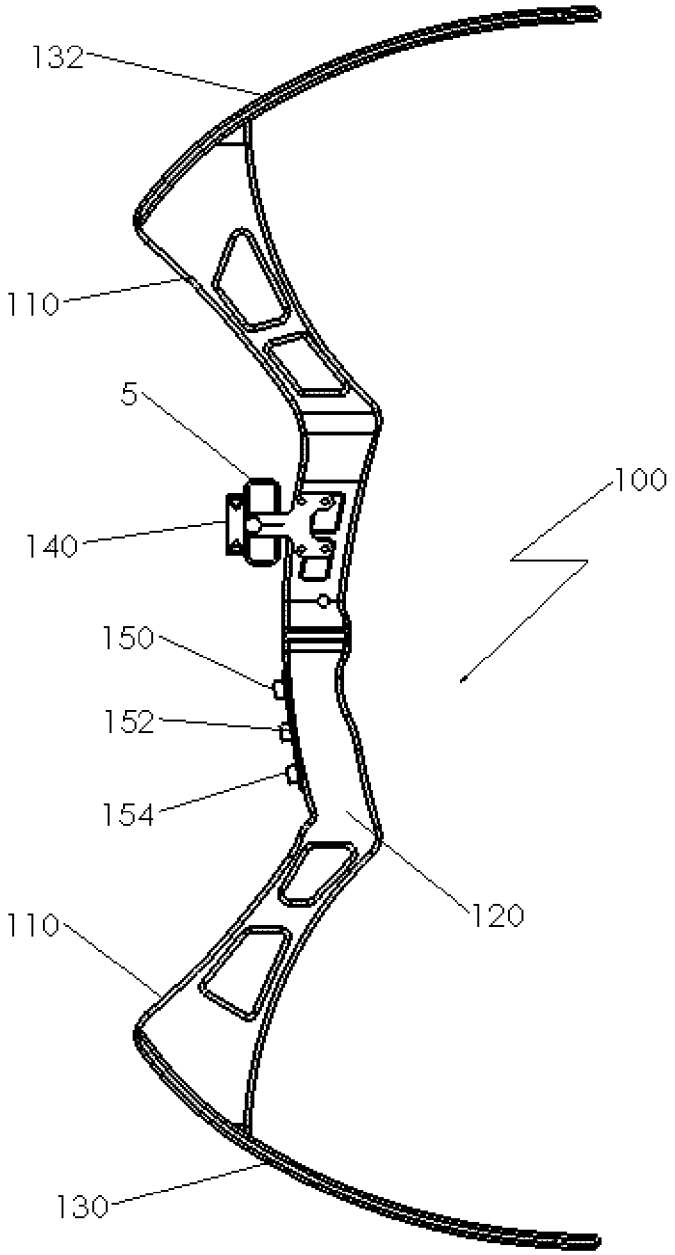
FIG. 1 is a plan view of a compound bow with an embodiment of a sight.

In one aspect, a sight for a weapon is described in which the sight includes different illuminable range indicators that are each independently associated with a single switch. When the associated switch is activated, the corresponding range indicator is illuminated, providing guidance to the shooter. Each switch is located at a position on the weapon where it can be activated by a different finger of the shooter's hand. Each of the switches is dedicated to a single range indicator, and with minimal practice the shooter will find that he or she is subconsciously associating a particular finger with a particular distance and that the proper range pin is illuminated without taking time to think or calculate which range pin is the proper one to use for a particular distance to target. The sight can be used with a variety of devices that shoot projectiles, including, for example, compound bows, recurve bows, crossbows and firearms.

When shooting at a target, it is important that the shooter is able to maintain concentration on both the target and the sight that is being used. Many different sights exist to compensate for the drop of a projectile at different distances, but these sights typically interfere with the shooter's concentration on the target because they require either manual or mental steps to initiate. For example, the shooter may have to glance at a range finder and then choose an appropriate sight. Or, after deciding on the estimated distance to target, some sight systems require the shooter to cycle through a set of distance options, requiring mental attention to the number of cycles or operations rather than allowing him or her to concentrate on the target and sight. In short, numerous options and electronic details have become a distraction rather than an aid in aligning the sight with the target. This requires numerous mental and mechanical steps, such as determining distance, dialing in that specific distance, cycling through various distance options and then confirming that the proper distance has been selected. All of these actions distract from the task at hand.

The sights described herein can provide a simplified link between the distance to the target and the selection of the appropriate range indicator. After minimal practice, muscle memory allows for a subconscious selection of a range indicator without distracting the shooter from the task at hand—aligning the sight with the target. Two or more switches are each independently associated with a different distance. The two or more switches may be operated by one finger, two fingers, or more. For example, the number of switches may be operated by the same number of fingers. Without needing to look away from the target and without needing to mentally count or calculate, the shooter associates a specific switch with a distance and activates that switch to illuminate the range indicator that is associated with that distance. The shooter doesn't even consider whether the range is a specific yardage such as 20 yards or 40 yards, but simply feels that the distance is a "pointer finger distance" or "a ring finger distance" and applies pressure to the corresponding finger, activating a switch. The proper range indicator is illuminated and the shooter can adjust his or her aim accordingly, without needing to adjust grip, perform mental calculations or glance away from the target and sight.

FIG. 1 provides a profile view of a compound archery bow 100 that is typical of a type used by archers for hunting and target shooting. The bow includes riser 110 that is connected to lower limb 130 and upper limb 132. Grip 120 is formed in or around riser 110, and sight 140 also mounts to riser 110. In this embodiment, switches 150, 152 and 154 are mounted in the grip area so that the shooter's hand does not need to be moved off the grip to activate any of the switches. The switches are positioned to be activated by the hand that is not pulling back the bow string. Switches may be, for example, mechanical or electronic and can be binary or variable. Not shown in FIG. 1 for reasons of clarity are the cams, cables and bow string that run between the distal ends of upper limb 132 and lower limb 130. In reference to FIG. 1, the flight of the arrow is from right to left and the left side of the bow in FIG. 1 will be referred to as the front, the right side as shown in FIG. 1 will be referred to as the rear of the bow.

Figure 2:
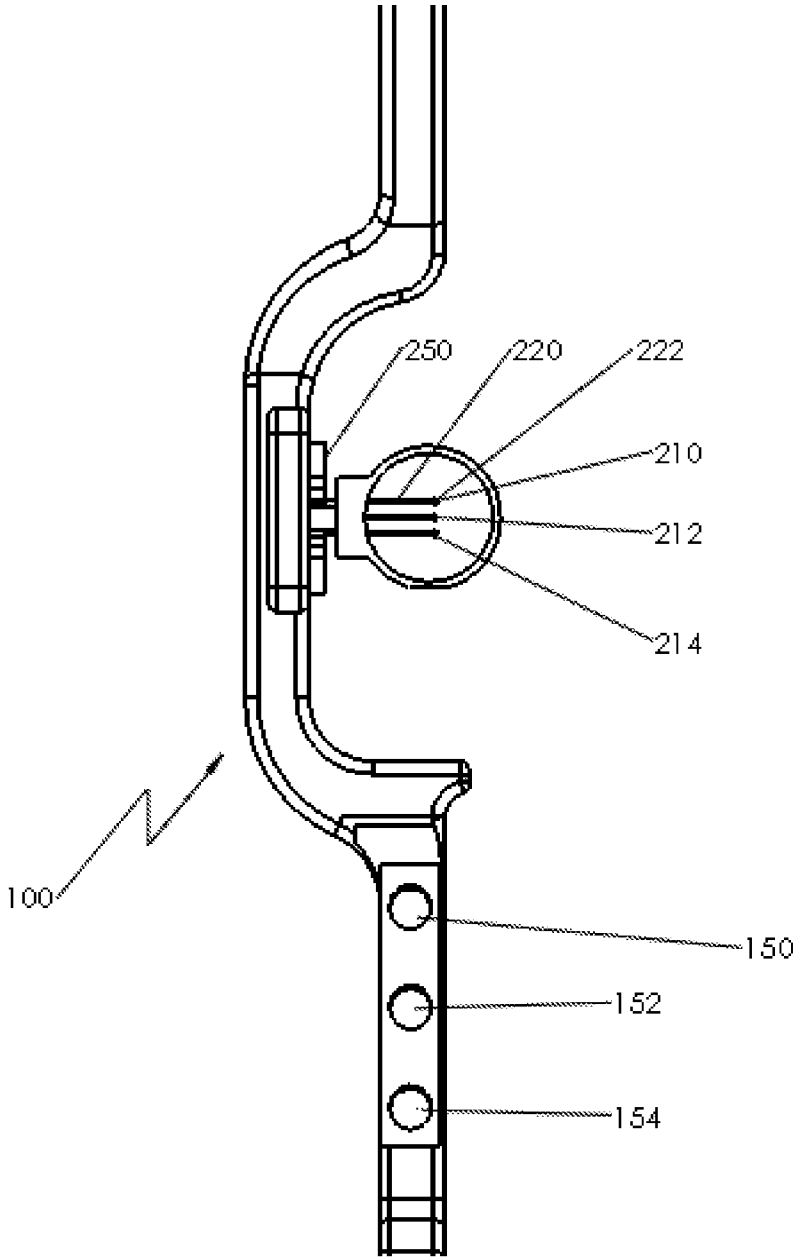
FIG. 2 is a frontal view of the sight of FIG. 1.

FIG. 2 is an enlarged view of the front of a portion of the bow of FIG. 1. Switches 150, 152 and 154 are electrically connected to range indicators 210, 212 and 214. The connection may be through a simple electric circuit or may include a microprocessor. As only shown for illuminable range indicator 210, each illuminable range indicator in this embodiment includes a post 220 and light emitter 222. Post 220 is fixed to housing 230 and can provide electrical connectivity between light emitter 222 and the connected switch 150. Post 220 may also be in communication with a light source via a fiber optic filament that can be mounted, for example, farther back on the riser. In other embodiments, light emitter 222 need not be electrically connected and can, for example, reflect a light source, such as a laser that is directed at the light emitter. Housing 230 can be a modular unit that is inserted into mount 250 that is fixed to the riser of the bow. Housing 230 can include a power source such as a battery and may in turn be electrically connected to switches 150, 152 and 154. The sight may include a microprocessor that can be secured in housing 230. In other embodiments, a microprocessor is not required and light emitters 222 are lit when the corresponding switch 150, 152 or 154 is activated to complete a simple circuit. The circuit may be a momentary circuit in which the corresponding light emitter is only lit when the switch is depressed. The switch can be biased in an open position, for example by a spring, so that when the shooter's finger is removed, or pressure reduced, the switch returns to its preferred open position and the light turns off. In other cases, the light can be lit by depressing or contacting the switch once and turned off by, for example, either pressing the same switch again or by pressing one of the other switches corresponding to a different target distance.

As shown, switches 150, 152 and 154 are button switches that activate the corresponding range indicator when the button is pressed naturally inwardly by the corresponding finger. In other embodiments, the switches can be any device that is used to complete an electrical circuit or to activate an electrical response. For instance, in different embodiments the switches can be touch sensitive switches, membrane switches, toggle switches or sliding switches. The switches may be on/off switches or may be a variable resistance or other type of switch that allows for a change in light intensity based on how far the switch is depressed or how much pressure is applied to the switch by the shooter. For instance, a greater amount of pressure may result in a brighter light from the light emitter that can be used in bright daylight while less pressure and less light may be more useful in low light conditions. In preferred embodiments, a single switch is associated with a single range pin, so that the user doesn't need to cycle through various settings to light up the proper range pin. In one embodiment, switch 150 activates range pin 214, switch 152 activated range pin 212 and switch 154 activates range pin 210. The lower range pin corresponds to a longer target distance because aligning the target with the range pin raises the path of the arrow to compensate for the additional drop that occurs over greater distances. Humans naturally associate a higher vertical position with a longer distance, so top button 150 may be configured to activate the longest distance range pin, in this case range pin 214. In one embodiment, range pin 210 may correspond to 20 yards from the target, range pin 212 may correspond to 30 yards from the target and range pin 214 may correspond to 40 yards from the target. In other embodiments, the upper most switch may be associated with the shortest distance while the lowest switch may be associated with the farthest distance.

In one set of embodiments, switch 150 is positioned to be accessible by the shooter's pointer finger without shifting the hand on the hand grip. In the same manner, switch 152 can be positioned for the middle finger and switch 154 for the ring finger. With very little decision making required, the shooter reactively activates the upper switch with the pointer finger for long distance, the middle one for middle distances and the lower one for shorter distances. The shooter need not look at the switches or think about a particular sequence and can simply concentrate on the target. The switches may be raised, as shown, or in some embodiments may be flush with the grip or countersunk into the grip. Switches may also be under the grip surface and may be partially or completely hidden by, for example, a pliable membrane. Although shown in vertical alignment, the switches may be vertically misaligned and may be in different positions around the grip. For instance, switches to be activated by the longer fingers may be positioned further around the grip so that the fingertip is over or close to the switch when the bow is gripped in the shooting position. Although FIG. 2 shows that the switches are mounted on the front, they may also be mounted on the side of the grip or in any position between the side and the front. In one embodiment, the switches are positioned on the side of the grip away from the palm, so that they are activated by the finger tips only. In this embodiment, accidental activation of the switches while gripping the weapon can be avoided. Switches may be any shape and can be, for example, round, oblong, rectangular or fingertip shaped. Switches may include tactile feedback so that the shooter is aware when the switch has been activated or deactivated.

The brightness of the range indicator may be varied under different lighting conditions. For example, in low light conditions, the range indicator can emit a low level of light so that the shooter's view of the target is not overwhelmed by the bright light of the range indicator. In daylight conditions, however, the range indicator may be brighter so that it can be seen against a bright background or with sunlight hitting the range indicators. In some embodiments, the brightness of the range indicator can be varied by the shooter prior to or during the aiming procedure. For instance, the amount of pressure that is applied to a corresponding pressure sensitive switch can be used to select a desired brightness level. For example, a switch may be pressure sensitive so that the more pressure that is applied, the greater the intensity of the corresponding range indicator. In this manner, light pressure can be applied in low light conditions and greater pressure can be applied in daylight or other high light conditions.

In some cases, two or more range pins may be illuminated concurrently when, for example, two or more switches are pressed simultaneously. When two range pins are illuminated, this can indicate to the shooter that the distance is in between two of the pre-selected ranges, and the target should be aligned with a space between the two light emitters that are illuminated. In some embodiments, the length of switch depression or the amount of pressure applied to the switch can vary the intensity of the light emitted from the corresponding range pin. In this manner, one range pin may be bright and a second one dim, indicating that the shooter should aim using the bright sight, but favor slightly the side of the bright sight that is closest to the dimly lit one. In this embodiment, the shooter can activate two switches to different degrees when he or she estimates the target distance is not exactly at and not exactly between any of the preset distances. This enables the shooter to use an analog transfer technique where the brain tells the shooter's fingers to push one switch a bit harder than the other when the perceived distance is, for example, "less than far but more than medium." It has been found that this is much faster and more intuitive than the shooter having to dial in, or otherwise convey, "27 yards," e.g., to the target. The shooter's fingers don't need to leave the grip and the shooter's eyes do not need to move from the target or the sight.

Figure 3:
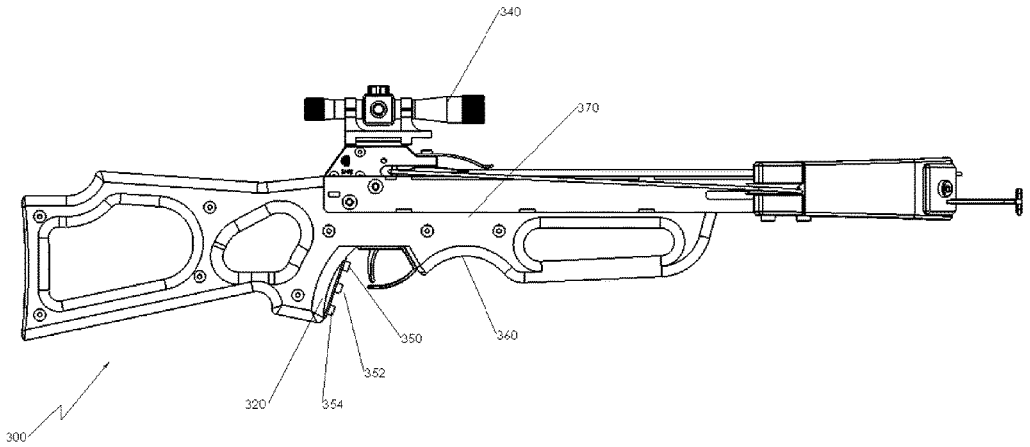
FIG. 3 is a plan view of a cross bow including a sight of one embodiment.
Figure 4:
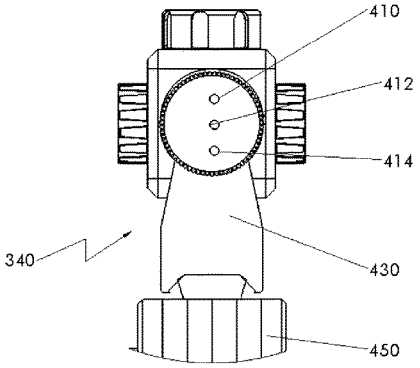
FIG. 4 is a rear view of a portion of the sight of FIG. 3.

FIGS. 3 and 4 illustrate an embodiment with a sight on a crossbow. Switches 350, 352 and 354 are installed in grip 320 and can function in the same manner as those described above. As shown, switch 350 is activated by the middle finger, switch 352 by the ring finger and 354 by the pinky finger. This leaves the forefinger in place on the trigger. Alternatively, switches may be placed on the stock 360 where they are activated by the hand that is not on the trigger. Scope 340 can be a telescopic or dot sight and can be mounted on the action or on a rail 450 at the top of receiver 370. FIG. 4 provides the view along line of sight 2 and shows what the shooter would see looking at the scope (sight) along the axis of the rifle. Light dots 410, 412 and 414 are vertically aligned in the window. Note that the light dots would be illuminated only when the corresponding switch is activated and that not all lights would be illuminated at the same time, as shown. This is in contrast to other systems where the shooter has to make a decision as to which dot to align with the target. Although the order of association can be changed, in this embodiment light dot 410 is activated by switch 354, light dot 412 is activated by switch 352 and light dot 414 is activated by switch 350. The dots may be similar or identical to those used in dot scopes, and a power source, such as a battery, may be the same or similar to those used in dot scopes. A power source may also be housed in grip 320 where the switches are positioned. The switches are independently in electrical communication with the light dots, and circuits can be run through or around housing 370 and eventually to scope 340.

Figure 5:
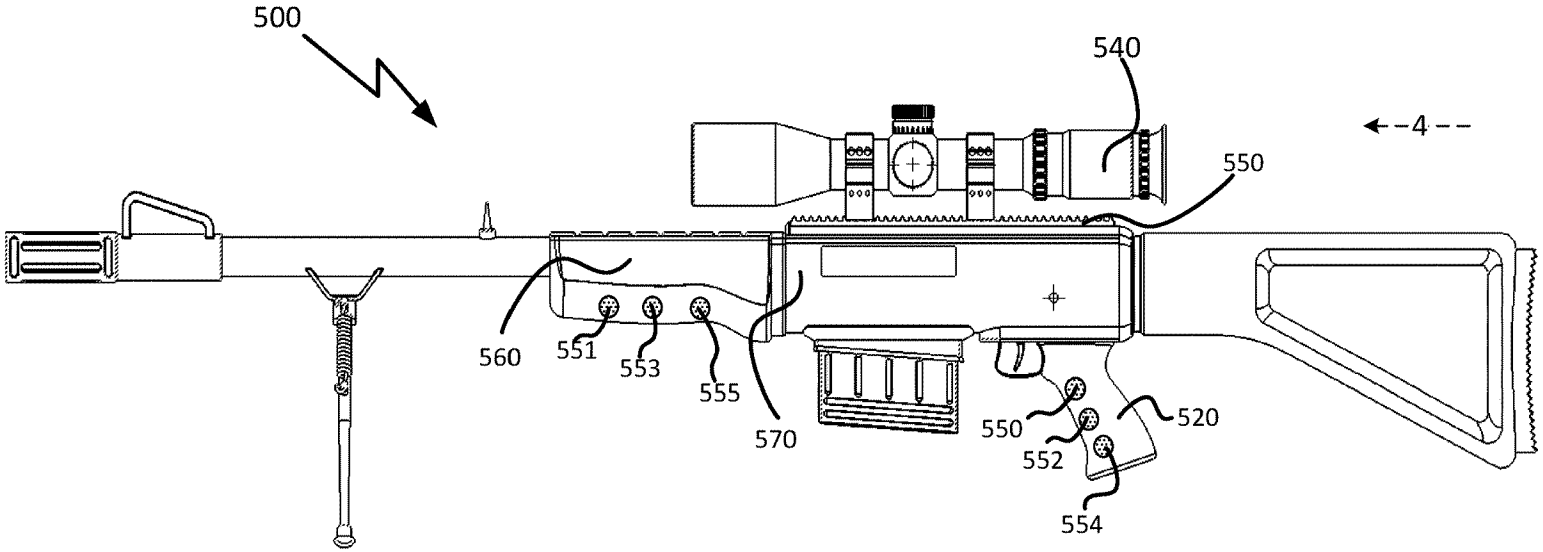
FIG. 5 is a plan view of a rifle including an embodiment of a sight.
Figure 6:
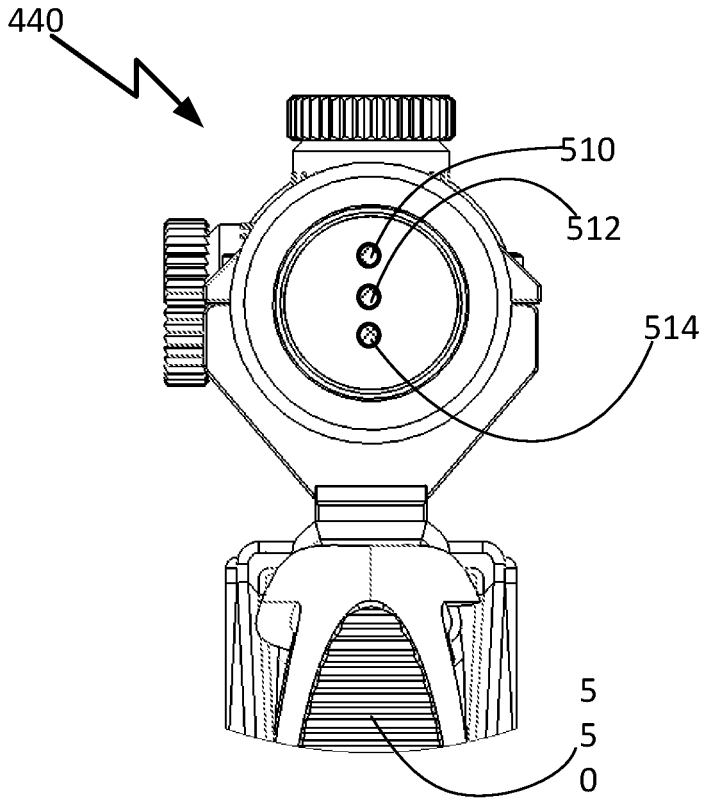
FIG. 6 is an axial view of a scope mounted on the rifle of FIG. 5 and illustrates the positioning of light emitting range dots of one embodiment.

FIGS. 5 and 6 illustrate an embodiment with a sight on a rifle. Switches 550, 552 and 554 are installed in grip 520 and can function in the same manner as those described above. As shown, switch 550 is activated by the middle finger, switch 552 by the ring finger and 554 by the pinky finger. This leaves the forefinger in place on the trigger. Alternatively, or in combination with the grip mounted switches, switches 551, 553 and 555 may be placed on stock 560 where they are activated by the hand that is not on the trigger. Scope 540 can be a telescopic or dot sight and can be mounted on the action or on a rail 550 at the top of receiver 570. FIG. 6 provides the view along line of sight 4 and shows what the shooter would see looking at the scope (sight) along the axis of the rifle. Light dots 510, 512 and 514 are vertically aligned in the window. Note that the light dots would be illuminated only when the corresponding switch is activated and that not all lights would be illuminated at the same time, as shown. This is in contrast to other systems where the shooter has to make a decision as to which dot to align with the target. Although the order of association can be changed, in this embodiment light dot 510 is activated by switch 554, light dot 512 is activated by switch 552 and light dot 514 is activated by switch 550. The dots may be similar or identical to those used in dot scopes, and a power source, such as a battery, may be the same or similar to those used in dot scopes. A power source may also be housed in grip 520 or stock 560 where the switches are positioned. The switches may be independently in electrical communication with the light dots, and circuits can be run through or around receiver 570, through rail 550 and bracket 530 and eventually to scope 540.

The specific association between a switch and a range pin may be pre-selected by the manufacturer or may be selectable by the user. The sight may include a microprocessor that includes software to allow the user to change the range pin that is activated by a specific switch. In an embodiment that does not require a microprocessor, the physical switches themselves can be interchangeable within the grip, and the user can remove the switch from one location and place it in a different one. For instance, a button type switch may be pressure fit into an uppermost receiving hole in the grip but can be popped out by the user and snapped into a lower receiving hole. The switch may be hard wired to a particular range pin, but when moved to a different receiving hole, the position with which the switch is associated activates a different range pin than it did previously. Thus, although pushing the switch itself may still activate the same range pin, by changing the relative position of the switch, a different finger can be used to activate it, providing a degree of flexibility in selected which switch position activates which range pin. This can provide the user with some flexibility to find what he or she believes is the most natural association between the physical position of the switch on the grip and a particular distance or range pin.

Figure 7A:
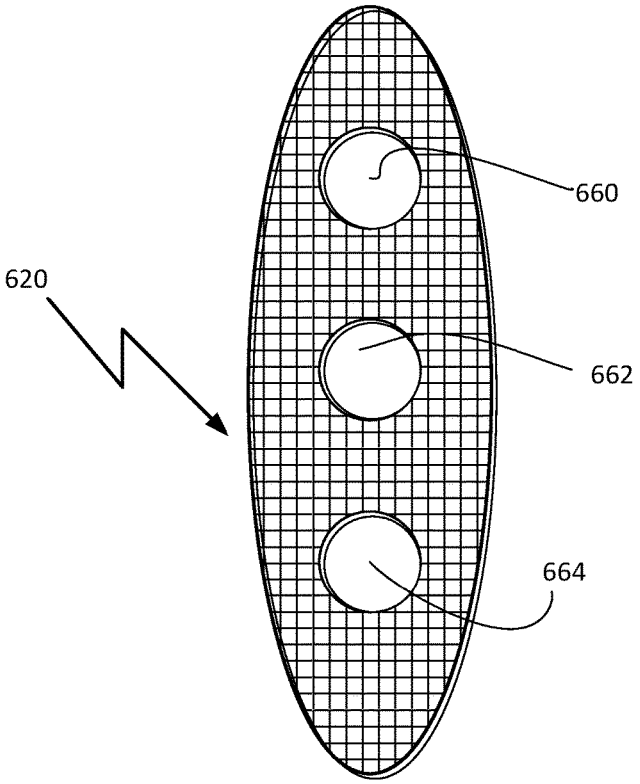
FIG. 7A provides a frontal view of one embodiment of a grip cover to be used with a bow.
Figure 7B:
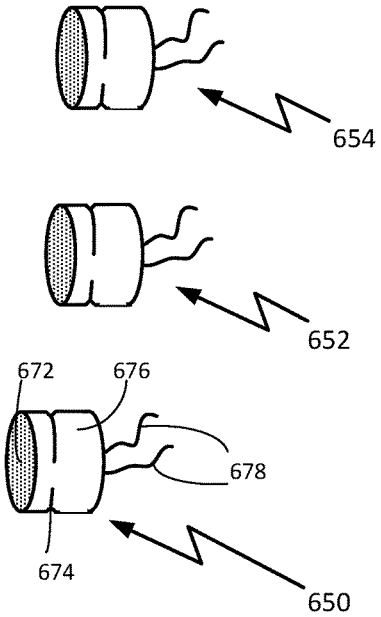
FIG. 7B provides profile views of three button switched configured to operate with the grip cover of FIG. 7A.

FIGS. 7A and 7B provide an illustration of an example wherein the switches are interchangeable by the user. FIG. 7A provides a frontal view of grip cover 620 that can wrap around the grip or replace the grip on a weapon such as a compound bow, rifle or crossbow. The grip cover may be, for example, molded or machined and can be of a flexible material such as plastic to allow it to be connected to the bow handle using the compressive forces of the biased plastic cover. Grip cover 620 can be securely attached to the grip of the bow and, as shown, may be removable. Grip cover 620 includes openings 660, 662 and 664 which each provide passageways through the cover. More or fewer openings may be included and the positions may be altered to accurately replicate the mapping of the shooter's fingers on the grip. Removable button switches 650, 652 and 654 are constructed to fit tightly into the openings and may therefore have a radius that is similar to that of the openings. As shown, button switches 650, 652 and 654 are substantially cylindrical and are similarly sized and shaped so that they are interchangeable with the different openings. As detailed for button switch 650, each button switch can include activation surface 672, switch body 676, electrical leads 678 and circumscribed indent 674 for seating the switch in the grip openings. When installing the switches, button switch 650, 652 or 654 can pushed through the opening of choice in the grip cover and will seat itself when circumscribed indent 674 is aligned with the circumference of the opening. The switch can be removed by applying enough pressure to cause deformation in the opening allowing the switch to be freed from the grip cover 620. Activation surface 672 can be a membrane switch, mechanical switch or any other button type switch that can be activated by the shooter. Electrical leads 678 can be permanently wired to specific range indicators, such as range pins, that are illuminated when the corresponding button switch is activated. The button switch can contain a battery or the power source may be external to the switch. In some cases, only one electrical lead may be required if the circuit can be completed through the body of the switch and through the grip or grip cover 620. The user can change the range indicator associated with a specific opening by swapping button switches 650, 652 and 654 between the available openings. In this manner, the user can customize the range finders that are activated by specific fingers without software, without connecting or disconnecting leads, and without turning on or off any external switches. While the switch itself may be permanently associated with a specific range pin, the position of that switch can be varied, allowing the user to choose a specific position on the grip to be associated with each range pin.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A sight for an archery bow or crossbow, the sight comprising:

at least two illuminable range pins affixed to the bow;

at least two switches affixed to the bow, each switch electrically connected exclusively to one of the illuminable range pins; and a power source constructed and arranged to illuminate a range pin when the connected switch is activated.

2. The sight of claim 1 wherein each switch is a momentary switch that is biased to an off position and illuminates the corresponding range pin only when a force is applied by a user.

3. The sight of claim 1 wherein each switch is an on/off switch that illuminates the corresponding range pin when activated.

4. The sight of claim 3 wherein the corresponding range pin is turned off when the corresponding switch is activated a second time.

5. The sight of claim 1 wherein the sight does not include a microprocessor.

6. The sight of claim 1 wherein the at least two range pins are arranged vertically, and the at least two switches are arranged vertically.

7. The sight of claim 6 wherein the lowest positioned of the at least two range pins is activated by the highest positioned of the at least two switches.

8. The sight of claim 1 wherein light from the range pins is produced by the range pin.

9. The sight of claim 1 wherein the range pins emit light that is reflected from another source.

10. The sight of claim 1 wherein more than one illuminable range pin can be illuminated concurrently.

11. A method of illuminating a range indicator, the method comprising:

determining an approximate distance to a target;

activating one of at least two switches vertically aligned on a grip of a weapon, each of the at least two switches configured to uniquely activate a different range sight that corresponds to a different target distance;

illuminating a range sight associated with the activated switch;

visually aligning the range sight with a target; and shooting a projectile at the target.

12. The method of claim 11 wherein each of the at least two switches is positioned on the grip to be activated by a finger of a user without changing the position of the user's hand on the grip.

13. The method of claim 11 wherein the highest vertically aligned switch is configured to activate the lowest positioned range sight.

14. The method of claim 11 wherein the weapon is a bow, crossbow or firearm.

15. The method of claim 14 wherein the weapon is a bow.

16. The method of claim 14 wherein the weapon is a firearm.

17. The method of claim 15 wherein the range sight is a range indicator.

18. The method of claim 16 wherein the range sight is a reticle.

19. The method of claim 11 wherein the range sight includes a light emitting portion.

20. The method of claim 11 further comprising adjusting the lateral positioning of the range sight to compensate for wind drift.

* * * * *